US011760559B2

(12) United States Patent
Polloni et al.

(10) Patent No.: US 11,760,559 B2
(45) Date of Patent: Sep. 19, 2023

(54) RIGID PACK FOR SMOKING ARTICLES PROVIDED WITH A HINGED LID

(71) Applicant: G.D SOCIETA' PER AZIONI, Bologna (IT)

(72) Inventors: Roberto Polloni, Bologna (IT); Luca Federici, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 0 days.

(21) Appl. No.: 17/631,352

(22) PCT Filed: Jul. 31, 2020

(86) PCT No.: PCT/IB2020/057253

§ 371 (c)(1),
(2) Date: Jan. 28, 2022

(87) PCT Pub. No.: WO2021/019505

PCT Pub. Date: Feb. 4, 2021

(65) Prior Publication Data

US 2022/0324633 A1 Oct. 13, 2022

(30) Foreign Application Priority Data

Aug. 1, 2019 (IT) ..... 102019000013659

(51) Int. Cl.
*B65D 85/10* (2006.01)
*A24F 15/12* (2006.01)

(52) U.S. Cl.
CPC ..... *B65D 85/10564* (2020.05); *A24F 15/12* (2013.01); *B65D 2215/02* (2013.01)

(58) Field of Classification Search
CPC ..... B65D 2215/02; B65D 85/10564; A45F 15/12

(Continued)

(56) References Cited

U.S. PATENT DOCUMENTS 4,216,898 A * 8/1980 Davies ..... B65D 5/6691 229/199
5,480,025 A * 1/1996 Draucker ..... B65D 85/1081 206/256

(Continued)

FOREIGN PATENT DOCUMENTS

EP 2985239 A1 2/2016
GB 2511310 A * 9/2014 ..... A24F 15/00

(Continued)

OTHER PUBLICATIONS

International Search Report and Written Opinion for Corresponding International Application No. PCT/IB2020/057253 dated Nov. 2, 2020.

*Primary Examiner* — Rafael A Ortiz
(74) *Attorney, Agent, or Firm* — MARSHALL, GERSTEIN & BORUN LLP

(57) ABSTRACT

A pack for smoking articles comprising: a group of smoking articles wrapped by an inner wrap and housed in a rigid outer container provided with a lid hinged to the outer container; a collar partially projecting from an open upper end; and a locking system comprising: a support element arranged in the outer container in contact with the collar and provided with two coupling wings, which project movably outwards to move closer or away from each other; and two first through openings, each obtained through a wall of the lid, houses at least a portion of a corresponding coupling wing, to activate the locking system, preventing the lid from rotating from the closed to the open position. An external action of the user releases the coupling wing to deactivate the locking system. The locking system can be reactivated by rotating the lid from the open position to the closed position.

11 Claims, 9 Drawing Sheets

(58) Field of Classification Search
USPC .... 206/259, 242, 265, 268, 1.5; 229/125.41, 229/125.36, 125.02, 909
See application file for complete search history.

(56) References Cited

U.S. PATENT DOCUMENTS

| | | | | |
|---|---|---|---|---|
| 9,139,354 | B2 * | 9/2015 | Holford | B65D 85/10564 |
| 2015/0164139 | A1 * | 6/2015 | Marchitto | B65D 25/205 206/268 |

FOREIGN PATENT DOCUMENTS

| | | | | |
|---|---|---|---|---|
| WO | WO-2011054650 | A1 * | 5/2011 | A24F 15/00 |
| WO | WO-2012/049701 | A2 | 4/2012 | |
| WO | WO-2012049701 | A2 * | 4/2012 | B65D 5/6691 |
| WO | WO-2014190122 | A1 * | 11/2014 | B65D 85/1045 |
| WO | WO-2015150893 | A1 * | 10/2015 | B60C 25/0521 |
| WO | WO-2016146491 | A1 * | 9/2016 | B65D 85/1018 |

* cited by examiner

RIGID PACK FOR SMOKING ARTICLES PROVIDED WITH A HINGED LID

CROSS-REFERENCE TO RELATED APPLICATIONS

This Patent Application is a U.S. national phase of International Patent Application No. PCT/IB2020/057253 filed Jul. 31, 2020, which claims the benefit of priority from Italian patent application no. 102019000013659 filed on Aug. 1, 2019, the respective disclosures of which are each incorporated herein by reference in their entireties.

TECHNICAL FIELD

The present invention relates to a rigid pack for smoking articles provided with a hinged lid.

The present invention finds advantageous application in a pack of cigarettes, to which the following description will make explicit reference without loss of generality.

In fact, in this document, reference will be made indiscriminately to the specific example of "cigarettes" rather than to the more general expression "smoking articles", without thereby loss in generality for other types of articles (such as cigars, or cigarillos, cigarettes of the electronic type or ecigs, auxiliary products, such as filters, refills for ecigs and other tobacco-based products or alternative components or tobacco substitutes).

BACKGROUND ART

Rigid packs for cigarettes with a hinged lid are currently the most popular packs for cigarettes on the market as they are simple to produce, easy and practical to use, and offer good protection for the cigarettes contained therein.

A rigid pack of cigarettes with a hinged lid comprises a group of cigarettes wrapped in a sheet of metallic paper wrap, defining an inner wrap and a rigid container, housing the inner wrap; the container is cup-shaped, has an open upper end and is provided with a lid, which is also cup-shaped and it is hinged to the container along a hinge, to rotate, relative to the container, between an open position and a closed position of the open end. A collar is normally provided, which is folded and connected to the inside of the container, projecting partially outwards from the open end and engaging a corresponding inner surface of the lid when the lid is arranged in the closed position.

The opening of a rigid pack of cigarettes with a hinged lid is simple and intuitive, also for a child and therefore a rigid pack of cigarettes with a hinged lid cannot be classified as "child-proof" or "child resistant", i.e. capable of preventing a child from opening it. Normally, a pack of cigarettes is classified as "child-proof" if the opening thereof, i.e. the possibility of accessing the contents, is blocked by mechanisms, which an uninstructed user would be unable to open. In other words, a pack of cigarettes is called "child-proof" when the opening thereof (and thus access to the contents) is unconventional and requires the application of particular forces or torques in predetermined points, or sequences of movements, which are not intuitive for the effective opening of the pack of cigarettes.

Packs of cigarettes provided with locking systems are also known for keeping the lid in a closed position, as described for example in WO2012049701A2, but which can also be opened easily by a child as the opening is conventional and doesn't comprises sequences of unintuitive movements to open it, which cannot therefore be classified as "child-proof". WO2012049701A2 describes a mechanism for closing the pack, which has a locking means, that is formed by a single button or a single wing. The locking means is obtained from a reinforcement flap in the front wall of the lid and it is glued directly to the front wall of the collar. In particular, the locking means is arranged in a central position of the front wall and it is configured to engage, only partially, a recess, which is not a through recess, obtained in the front wall of the lid. In order to rotate the hinged lid from the closed position to the open position, the user must open the locking means, simply by pressing on the locking means, which, being directly connected to the collar, deforms it elastically towards the group of cigarettes and disengages it from the recess. Therefore, no sequence of unintuitive movements is required to open it in WO2012049701A2.

DISCLOSURE OF INVENTION

Thus, it is an object of the present invention to provide a rigid pack for smoking articles provided with a hinged lid, which is devoid of the drawbacks of the prior art, and which is cheap and easy to make.

According to the present invention a rigid pack for smoking articles is provided with a hinged lid, according to what is claimed in the attached claims.

BRIEF DESCRIPTION OF THE DRAWINGS

The present invention will now be described with reference to the attached drawings, showing non-limiting embodiments thereof, wherein.

BEST MODE FOR CARRYING OUT THE INVENTION

Figure 2:
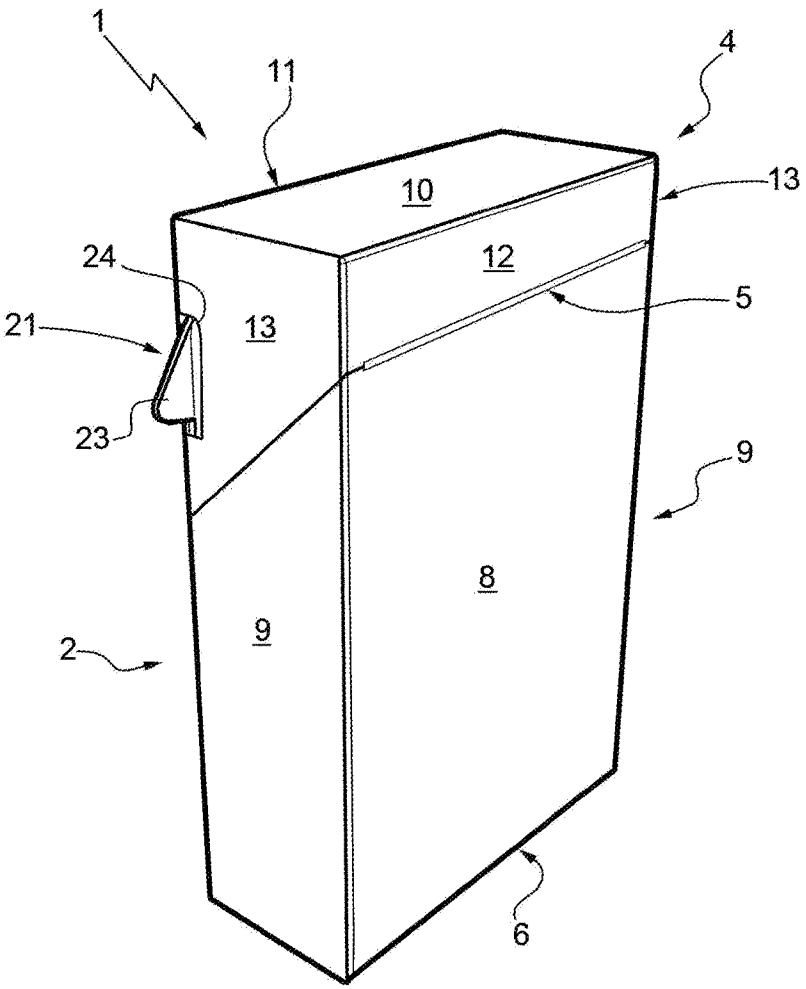
FIG. 2 is a rear perspective view of the pack of cigarettes in FIG. 1 in the closed configuration.

In FIGS. 1-6 number 1 denotes as a whole a rigid packet of cigarettes according to a preferred embodiment. The pack 1 of cigarettes comprises a rigid outer container 2 (i.e. consisting of cardboard or rigid cardboard), which is cup-shaped, has an open upper end 3 (visible in FIG. 3-6), and is provided with a lid 4. The lid 4 is cup-shaped and it is hinged to the outer container 2 along a hinge 5 (shown in FIG. 2) for rotating, relative to the outer container 2, between an open position (shown in FIGS. 3-6) and a closed position (shown in FIGS. 1 and 2).

The outer container 2 has a substantially rectangular parallelepiped shape oriented according to a prevalent vertical direction of development, it is cup-shaped and has an open upper end, a lower wall 6 opposed to the open upper end 3, a front wall 7 and a rear wall 8 (in which the hinge 5 is arranged), parallel and opposed to each other, and two side walls 9, which are parallel and opposed to each other. Four longitudinal edges are defined between the front 7, rear 8 and side 9 walls of the container 2, while four transversal edges are defined between the walls 7, 8 and 9 and the lower wall 6 of the container 2.

The cover 4 has a substantially rectangular parallelepiped shape, it is cup-shaped and has an open lower end (facing the open upper end 3 of the container 2 when the lid 4 is in the closed position), an upper wall 10 (which is parallel and opposed to the lower wall 6 of the outer container 2 when the lid 4 is in the closed position), a front wall 11 (which is parallel and aligned with the front wall 7 of the outer container 2 when the lid 4 is in the closed position), a rear wall 12 (which is parallel and aligned with the rear wall 8 of the outer container 2 when the lid 4 is in the closed position and it is hinged to the rear wall 8 of the outer container 2 along the hinge 5), and two side walls 13 parallel and opposed to each other (which are parallel and aligned, in particular, coplanar and adjacent, to the side walls 9 of the outer container 2 when the lid 4 is in the closed position). Four longitudinal edges are defined between the front 11, rear 12 and side 13 walls of the lid 4, while four transversal edges are defined between the walls 11, 12 and 13 and the upper wall 10 of the lid 4. The longitudinal edges and the transversal edges of the lid 4 are parallel and aligned with the corresponding longitudinal and transversal edges of the outer container 2 when the lid 4 is in the closed position.

According to the illustration in FIGS. 3-6, the pack 1 of cigarettes further comprises a rigid collar 14, which is connected (by means of gluing) folded in a "U" inside the outer container 2 partially projecting outwards from the open upper end 3 of the outer container 2 and engaging a corresponding inner surface of the lid 4 when the lid 4 is arranged in the closed position. The collar 14 comprises a front wall 15, which is connected to the front wall 7 of the outer container 2 and it is arranged in contact with the front wall 11 of the lid 4 when the lid 4 is in the closed position, and two side walls 16, which are connected to the side walls 9 of the outer container 2 and arranged in contact with the side walls 13 of the lid 4 when the lid 4 is in the closed position.

The front wall 15 is provided with an extraction opening 20 (shown in FIGS. 3-6) through which access to the contents of the pack 1 of cigarettes is facilitated.

According to the embodiment shown in the attached FIGS. 3-6, the front wall 15 of the collar 14 is devoid of a pair of claws, projecting laterally.

According to a different and conventional embodiment, which is not shown, the front wall 15 of the collar 14 is provided with the pair of claws, which project laterally to engage, by interference, the side walls 13 of the lid 4 when it is in the closed position, so as to keep the lid 4 in the closed position.

Figure 8:
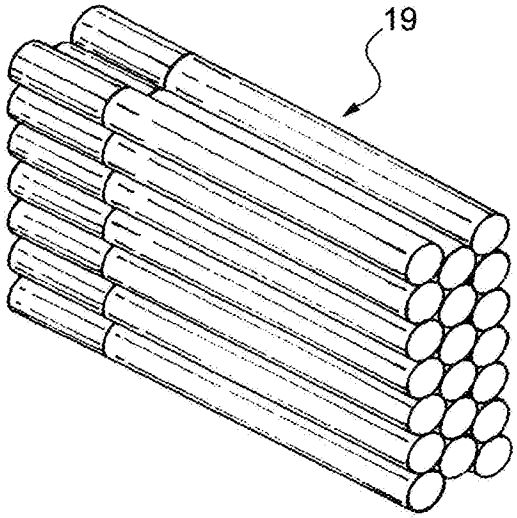
FIG. 8 is a perspective view of a group of cigarettes housed in the inner wrap in FIG. 7.
Figure 7:
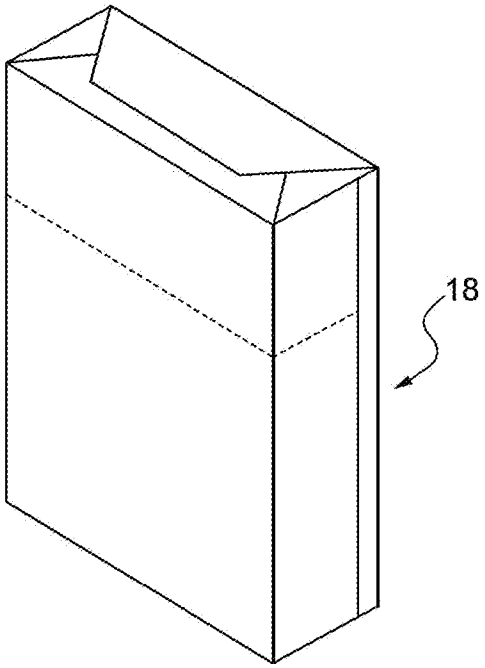
FIG. 7 is a perspective view of an inner wrap of the pack of cigarettes in FIGS. 1-6.

According to the illustration in FIGS. 7 and 8, the pack 1 of cigarettes comprises an inner wrap 18, which is arranged (housed) in the outer container 2, projecting partially outwards from the open upper end 3 and containing a group 19 of cigarettes. In the embodiment shown in the attached Figures, the inner wrap 18 is of the traditional type (i.e. not sealed) and it has an upper removable tear-off portion (the so-called "pull") which must be removed when the pack 1 of cigarettes is first opened in order to access the cigarettes.

According to an alternative embodiment, the inner wrap 18 is of the sealed type and has an extraction opening, which is engaged by a reusable closing label (i.e. provided with a re-positionable glue).

Figure 1:
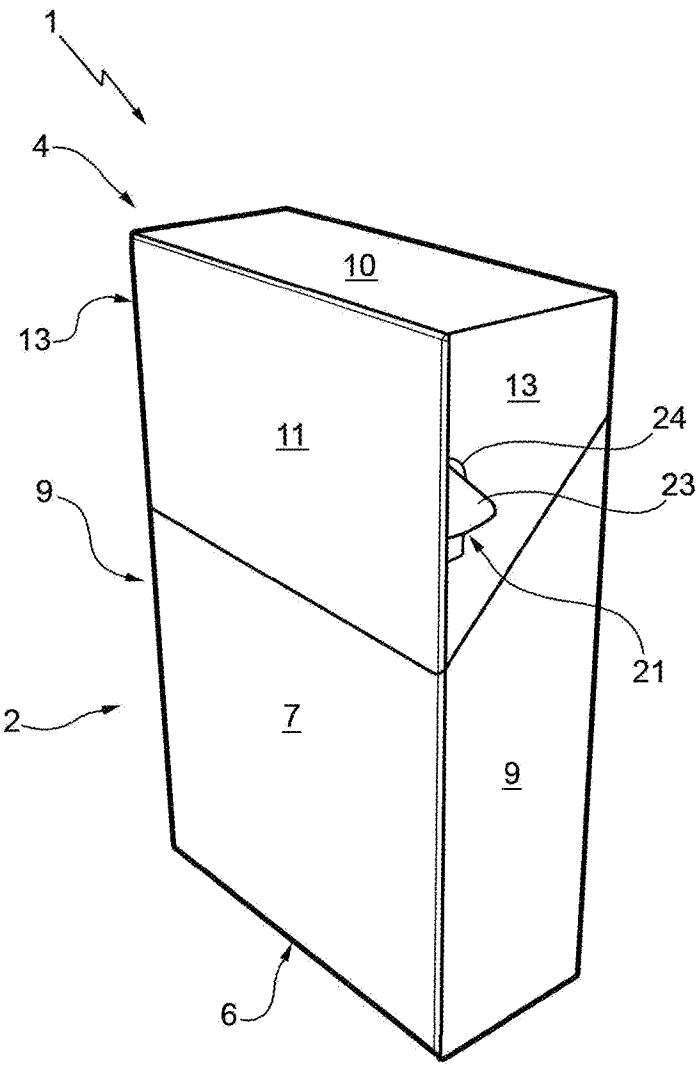
FIG. 1 is a front perspective view of a pack of cigarettes in the closed configuration and made according to the present invention.

According to the illustration in FIGS. 1-6, the pack 1 of cigarettes comprises a locking system 21, which normally prevents the lid 4 from rotating from the closed position to the open position. The locking system 21 can be deactivated through an external action of the user to allow the lid 4 to rotate from the closed position to the open position, and it can be reactivated by rotating the lid 4 from the open position to the closed position. In particular, the locking system 21 is reactivated (as shown in FIGS. 1 and 2) in an automatic and autonomous manner when the lid 4 is completely closed.

As shown in FIGS. 1-6, the locking system 21 comprises a support element 22, a pair of coupling wings 23, which extend from the support element 22 and two through openings 24 obtained through the front wall 11 and/or the side wall 13 of the lid 4.

According to the illustration in the attached Figures, the through openings 24 are obtained at the longitudinal edges comprised between the front wall 11 and the respective side wall 13 of the lid 4.

The support element 22 is flat. In particular, the support element 22 is arranged in the outer container 2 in contact with the collar 14 and it can be arranged between the outer container 2 and the collar 14, or between the collar 14 and the inner wrap 18.

The two coupling wings 23 project laterally, in particular each from opposite sides, outwards and they are movably carried by the support element 22, so that they can move closer to, or away from each other. In other words, the support element 22 has such a shape as to ensure an elastic deformation thereof to move the two coupling wings 23 closer or away, when the user operates the locking system 21 and in particular, when the user presses on the same two coupling wings 23.

The locking system 21 comprises the two through openings 24, each of which is obtained through a front wall 11 and/or the respective side wall 13 of the lid 4. Each through opening 24 houses at least one portion of the corresponding coupling wing 23 in order to activate the locking system 21, and it releases the corresponding coupling wing 23 arranged therein through an external action of the user on the coupling wing 23 to deactivate the locking system 21. In other words, in the closed position of the lid 4, the coupling wings 23 are arranged through, i.e. they project outwards past, the respective through opening 24 so as to create a mechanical constraint and prevent the lid 4 from rotating from the closed position to the open position. To open the pack 1 of cigarettes, i.e. when the user wants to move the lid 4 from the closed position to the open position, the user must operate the coupling wings 23 so that they disengage the respective through opening 24. In particular, to operate the coupling wings 23, the user must squeeze, i.e. press the pair of coupling wings 23 at the same time (in particular, the portion, which projects past the respective through opening 24 of the coupling wings 23) in order to bring them towards each other. Thereby, the support element 22 being elastically deformable, the coupling wings 23 disengage the respective through opening 24 and the lid 4 can rotate. After disengaging the respective through opening 24, the coupling wings 23 and the support element 22 are arranged in the initial conformation thereof, i.e. the conformation, which is not elastically deformed.

Note that when the lid 4 is closed again by the user, the coupling wings 23, by virtue of the substantially triangular shape thereof, are automatically inserted into the respective through openings 24.

Figure 4:
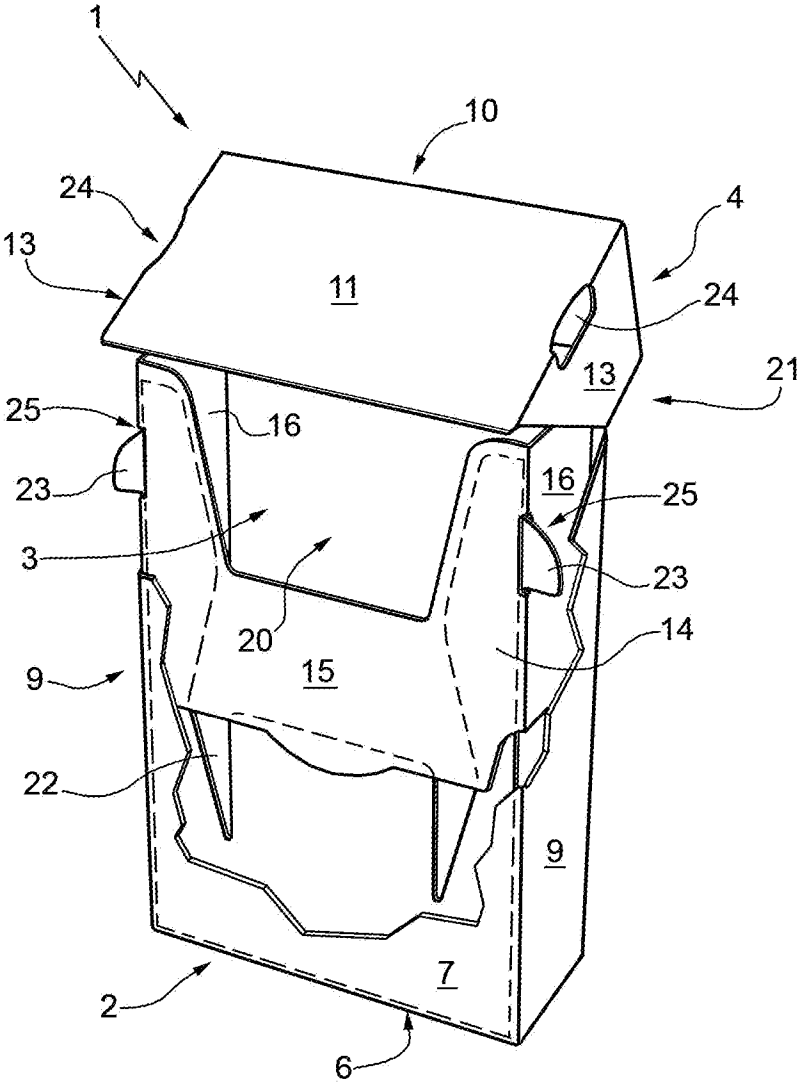
FIG. 4 is a front perspective view of the pack of cigarettes in FIG. 3 with parts removed for clarity and made according to a first embodiment.
Figure 3:
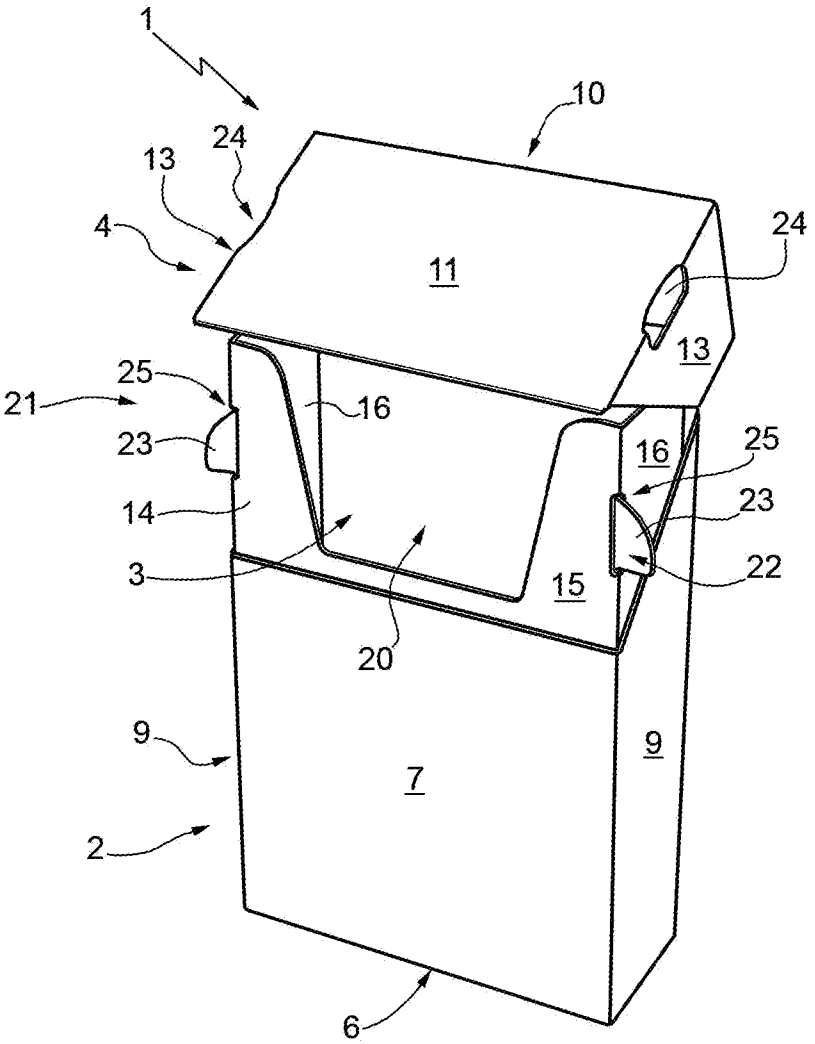
FIG. 3 is a front perspective view of the pack of cigarettes in FIG. 1 in the open configuration.
Figure 6:
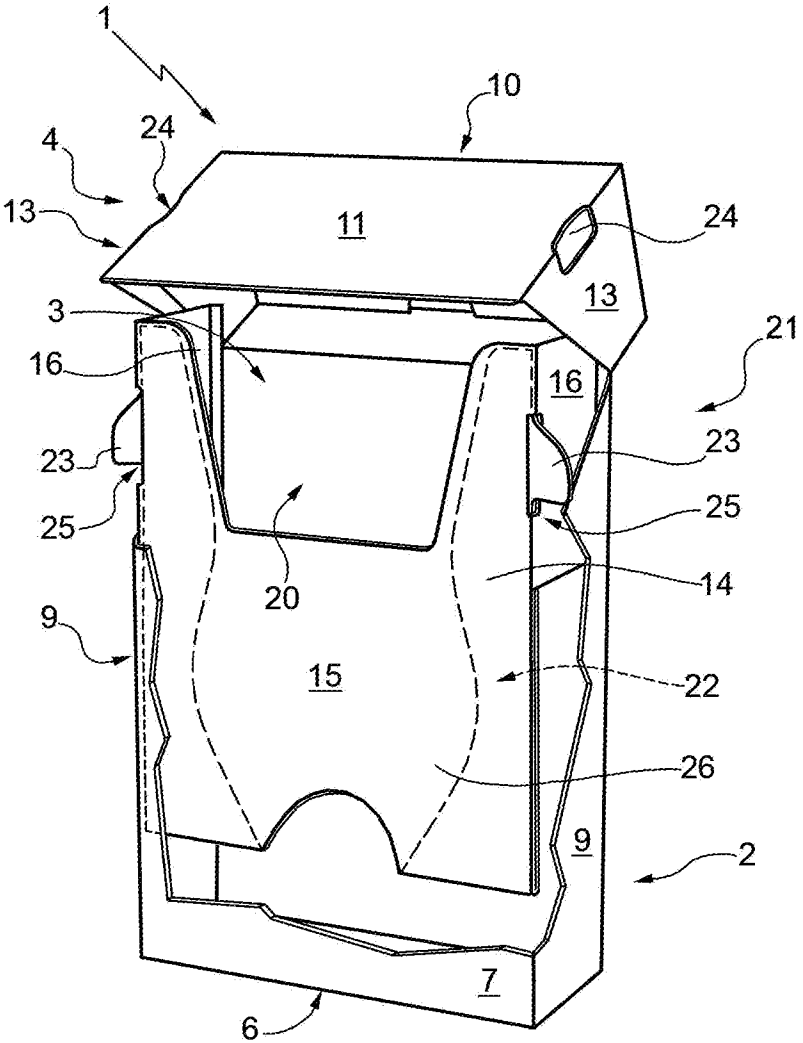
FIG. 6 is a front perspective view of the pack of cigarettes in FIG. 3 with parts removed for clarity and made according to a third embodiment.
Figure 5:
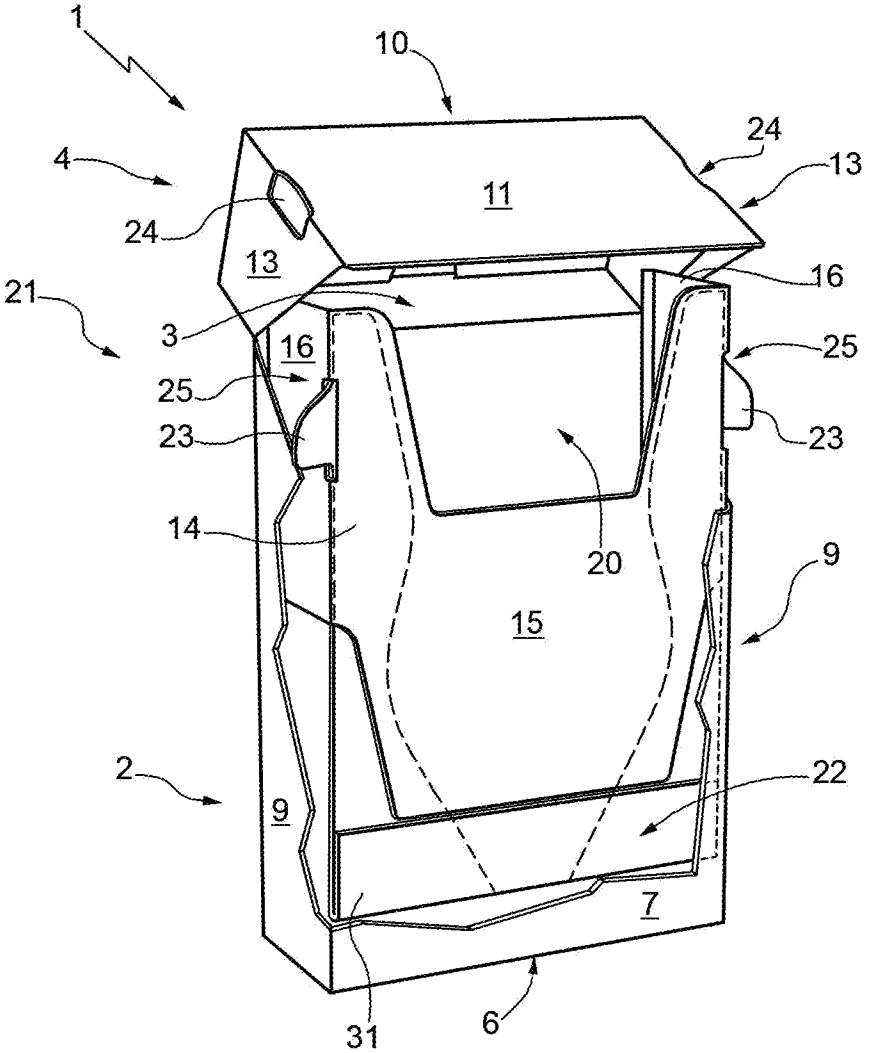
FIG. 5 is a front perspective view of the pack of cigarettes in FIG. 3 with parts removed for clarity and made according to a second embodiment.

According to the embodiments shown in FIGS. 1-6, the support element 22 is arranged between the inner wrap 18 and the collar 14. A portion of the outer container 2 has been removed in FIGS. 4-6 so as to show the arrangement of the support element 22. Therefore, in FIGS. 4-6, the collar 14 and portions of the support element 22, which are visible in the respective Figures, are indicated with the continuous line. Whereas, the covered portions, in particular, the portions of the support element 22 covered by the collar 14 and therefore, which are not visible from the FIGS. 4-6, are indicated with the dotted line.

The collar 14 has two seats 25, into which the coupling wings 23 are inserted.

Figure 10A:
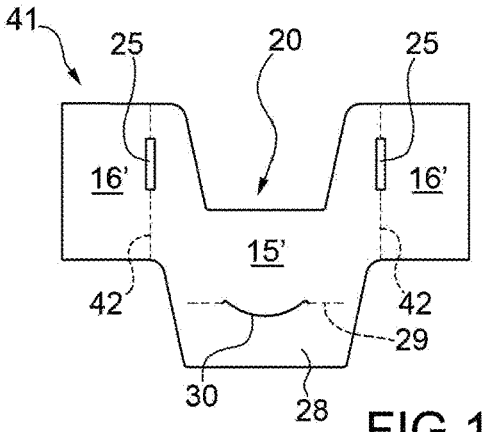
FIG. 10 is a plan view of a blank used to make a collar of the pack illustrated in FIG. 4.
Figure 10B:
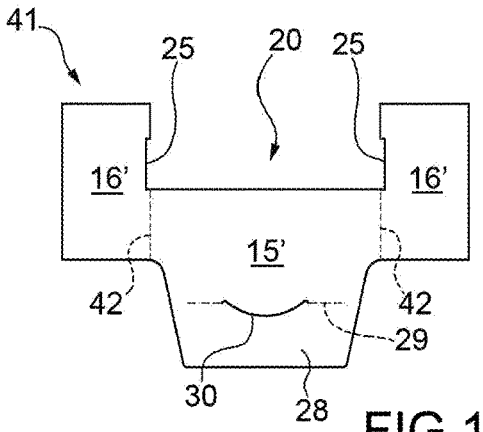

The seats 25 can comprise through openings at the edge, for example, between the front wall 15 and the respective side wall 16 of the collar 14 (as shown in FIGS. 1-6, 10*a*, 12, 14*a*, 14*b* and 16) or two trenches made at the edge of the extraction opening 20 (as shown in FIG. 10*b*), which extends to the edge between the front wall 15 and the respective side wall 16 of the collar 14.

Therefore, according to the illustration in the attached Figures, the seats 25 are obtained at the longitudinal edges comprised between the front wall 15 and the respective side wall 16 of the collar 14.

In the open position of the lid 4, the coupling wings 23 only cross the respective seat 25 of the collar 14. While, in the closed position of the lid 4, the coupling wings 23 cross both the seat 25 of the collar 14 and the through opening 24 of the lid 4. Therefore, in the closed position of the lid 4 the respective through opening 24 of the lid 4 is substantially facing the respective seat 25 of the collar 14.

In the embodiments shown in FIGS. 18*a*, 18*b*, 19*a* and 19*b*, the seat 25 is obtained by folding two panels 16' by 90° relative to a central panel 43, interposed between the two panels 16', along a respective pre-weakened longitudinal folding line 42. In particular, the seat 25 is delimited by a portion of a separating line 44, which partially separates the central panel 43 from the respective panel 16'.

As shown in the attached Figures, the support element 22 has a main wall 26 and a pair of appendages 27, which are coplanar to the main wall 26, originate from opposite ends of the main wall 26, are spaced apart and separate from one another and each support a respective coupling wing 23.

In the embodiments shown in the attached Figures, the appendages 27 have such a shape, in particular a conformation, to ensure an elastic deformation thereof, thus allowing the two coupling wings 23 to be moved closer to each other and, at the same time, ensuring the stability of the support element 22. In particular, an inner edge 35 of one of the two appendages 27 has at least one portion, i.e. section, which is convergent, divergent or parallel to the inner edge 35 of the other appendage 27 of the support element 22.

According to the illustration in FIGS. 3-6, the main wall 26 of the support element 22 is parallel to the front wall 7 of the outer container 2 and to the front wall 15 of the collar 14.

According to the illustration in the attached Figures, the main wall 26 of the support element 22 is substantially in contact with the front wall 15 of the collar 14.

Advantageously, the front wall 15 of the collar 14 has an extraction opening 20 having a transversal extension, which is smaller than a distance between the two inner edges of the two appendages 27 of the support element 22 so that the front wall 15 of the collar 14 completely covers the two appendages 27 of the support element 22. The transversal extension is understood to mean both the width, i.e. the size measured along a direction substantially transversal to the longitudinal extension of the pack 1 of cigarettes, and the height, i.e. the size measured along a direction substantially parallel to the longitudinal extension of the pack 1 of cigarettes. Therefore, viewing the pack 1 of cigarettes from the front (i.e. looking at it substantially perpendicular to the wall 7 of the outer container 2), the support element 22 doesn't project from the collar 14 at the extraction opening 20 and, therefore, it cannot be seen by the user.

According to the embodiment shown in FIG. 4, the collar 14 has a portion 28 (shown in FIGS. 10 and 16) of the front wall 15, which is folded by 180° along a transversal folding line 29 (shown in FIGS. 10 and 16) against the front wall 15. Incisions and/or cuts can be present along the folding line 29. Preferably, the folded portion 28 is oriented, i.e. facing the group 19 of cigarettes (as shown in FIG. 4) in such a way as to create a mechanical constraint with the support element 22. Therefore, the support element 22 doesn't need to be glued to the collar 14. However, the support element 22 could be glued to the collar 14; in particular, the folded portion 28 of the collar 14 can be glued or not glued to the front wall 15 of the collar. In this embodiment, the collar 14 has, at the front wall 15, an incision line 30.

As shown in FIG. 10, the incision line 30 has an arc-of-a-circle shape. In particular, the incision line 30 substantially starts and ends at the folding line 29. The incision line 30 is made to house a lower end of the support element 22, creating a mechanical constraint with the support element 22.

Figure 13:
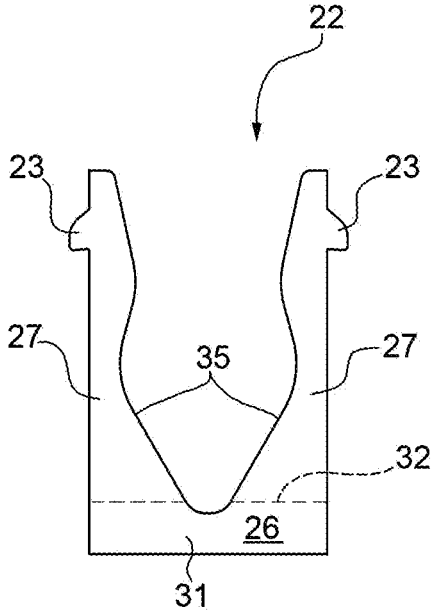
FIG. 13 is a plan view of a blank used to make the support element of the pack illustrated in FIG. 5.

According to the embodiment shown in FIG. 5, at least one portion 31 (shown in FIG. 13) of the main wall 26 is folded by 180° along a transversal folding line 32 against the appendages 27. Preferably, the portion 31 is glued to the appendages 27. Alternatively, the portion 31 of the main wall 26 might not be glued to the appendages 27. Preferably, the portion 31 is oriented, i.e. facing, the front wall 7 of the outer container 2 (as shown in FIG. 5). Alternatively, the folded portion 31 is oriented, i.e. facing the group 19 of cigarettes (not shown).

According to the embodiment in FIG. 5, the support element 22 is glued, together with the collar 14, to the front wall 7 of the outer container 2. In other words, in this embodiment, the portion 31 of the main wall 26 of the support element 22 is placed side-by-side and coplanar to the front wall 15 of the collar 14 and the appendages 27 are arranged against the front wall 15 of the collar 14 and facing the inner wrap 18. Thereby, the portion 31 of the main wall 26 of the support element 22 compensates for the thickness of the collar 14, in the event of also desiring to glue the element 22 to the outer container 2.

According to the embodiment shown in FIG. 6, the support element 22 is an extension of the front wall 15 of the collar 14 and the appendages 27 are folded by 180° along a pre-weakened transversal folding line 33 (shown in FIG. 14*a*) against the collar 14. In other words, the main wall 26 of the support element 22 is connected without gaps to the front wall 15 of the collar 14 and the appendages 27 are connected to the main wall 26 of the support element 22 along the preweakend transversal folding line 33 and folded by 180° along the preweakened transversal folding line 33 against the main wall 26 of the support element 22 and against the front wall 15 of the collar 14, facing the inner wrap 18.

Therefore, the support element 22 and the collar 14 are obtained from a single element (i.e. a single flat blank 34), which has the pre-weakened transversal folding line 33. At least a part of the support element 22 and the collar 14 are folded by 180° relative to each other along the pre-weakened transversal folding line 33.

Figure 14A:
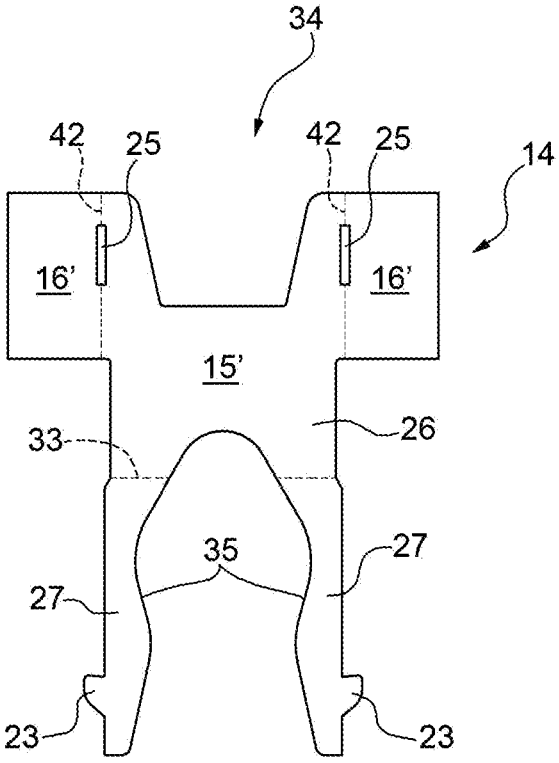
FIG. 14*a* is a plan view of a blank used to make the support element of the pack illustrated in FIG. 6.
Figure 14B:
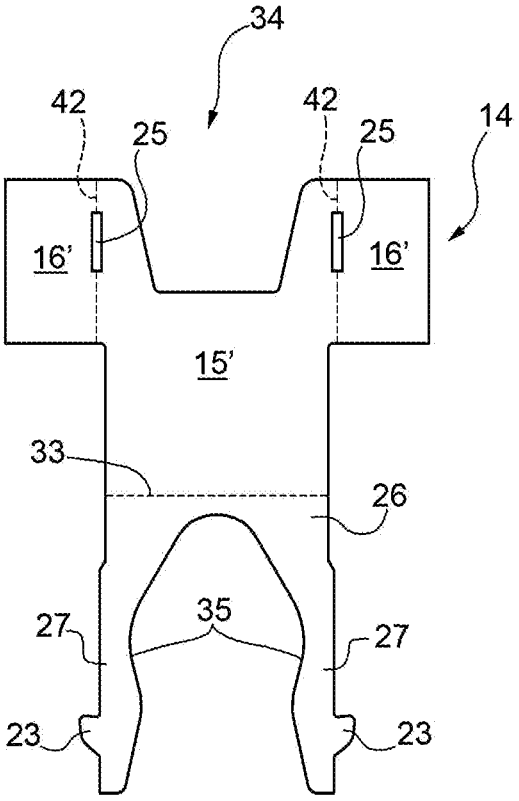
FIG. 14*b* is a plan view of an alternative blank used to make the support element.

According to an alternative embodiment shown in FIG. 14*b*, the support element 22 and the collar 14 are obtained from a single element (i.e. the flat blank 34), and the main wall 26 of the support element 22 and the front wall 15 of the collar 14 are connected to each other by the preweakened transversal folding line 33, around which they are folded by 180°, so they are arranged in contact with each other, i.e. to arrange the main wall 26 of the support element 22 and the appendages 27 against the front wall 15 of the collar 14. In other words, the main wall 26 of the support element 22 and the appendages 27 are connected without gaps, they lie coplanar and they are folded between each other. The collar 14 is glued to the front wall 7 of the outer container 2 and it may be or it may not be glued to the main wall 26 of the support element 22.

In the embodiments shown in FIGS. 1 to 6, the two coupling wings 23 are aligned with one another transversely and, similarly, the two through openings 24 are aligned with one another transversely. In other words, the two coupling wings 23 are arranged at a height, i.e. the size measured along the longitudinal extension of the pack 1 of cigarettes between the coupling wing 23 and the upper wall 10 of the lid 4 (when the latter is in the closed position), which is substantially equal for both of the coupling wings 23 and thus, for both of the through openings 24.

Alternatively, the two coupling wings 23 are not aligned with one another transversely and similarly, the two through openings 24 are not aligned with one another transversely. In other words, the two coupling wings 23 are arranged at a distance, i.e. the size measured along the longitudinal extension of the pack 1 of cigarettes between the coupling wing 23 and the upper wall 10 of the lid 4 (when the latter is in the closed position), which is different for each coupling wing 23 and thus for each through hole 24.

According to a possible embodiment, the outer container 2, the lid 4, the collar 14 and the support element 22 are made of paper materials.

According to an alternative embodiment, the outer container 2, the lid 4 and the collar 14 are made of paper materials; while the support element 22 is made of a plastic material so that it cannot tear.

Figure 9:
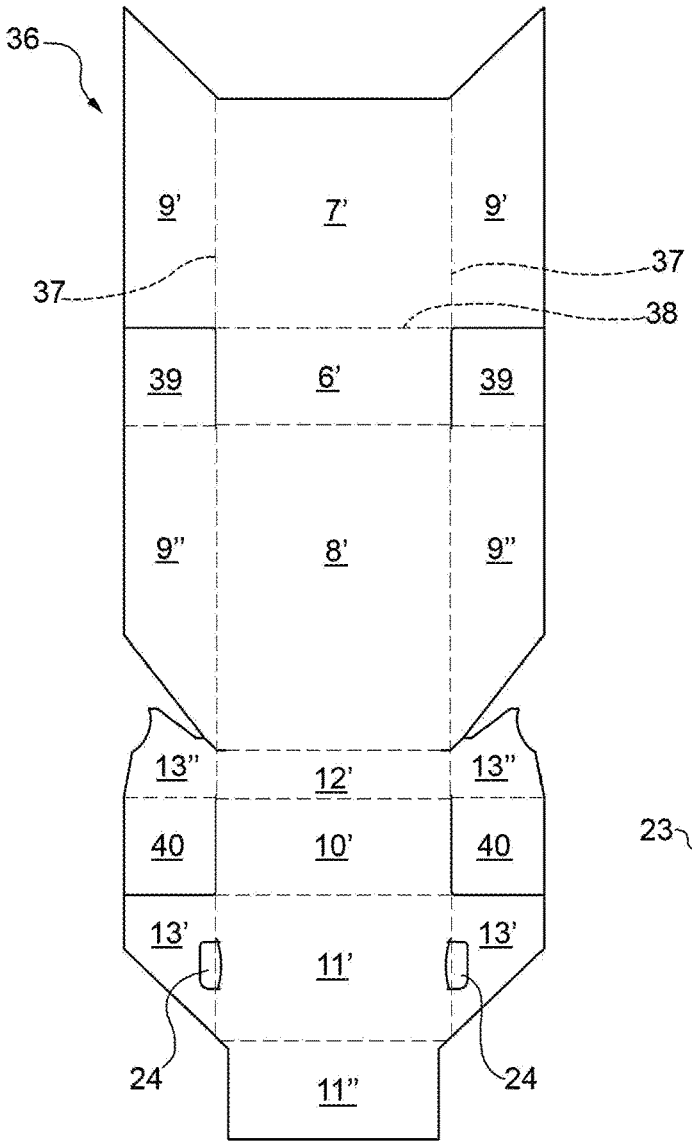
FIG. 9 is a plan view of a blank used to make the outer container of the pack illustrated in FIGS. 1-6.
Figure 11:
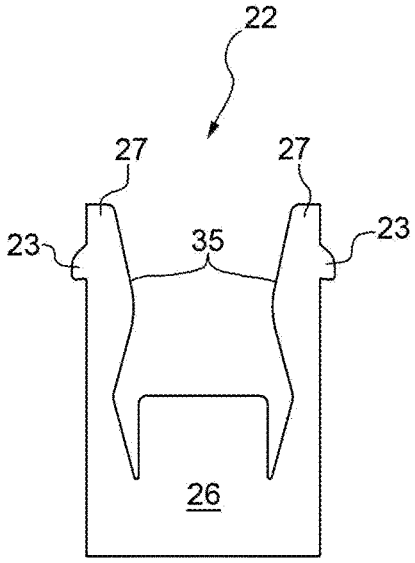
FIG. 11 is a plan view of a blank used to make a support element of the pack illustrated in FIG. 4.
Figure 15:
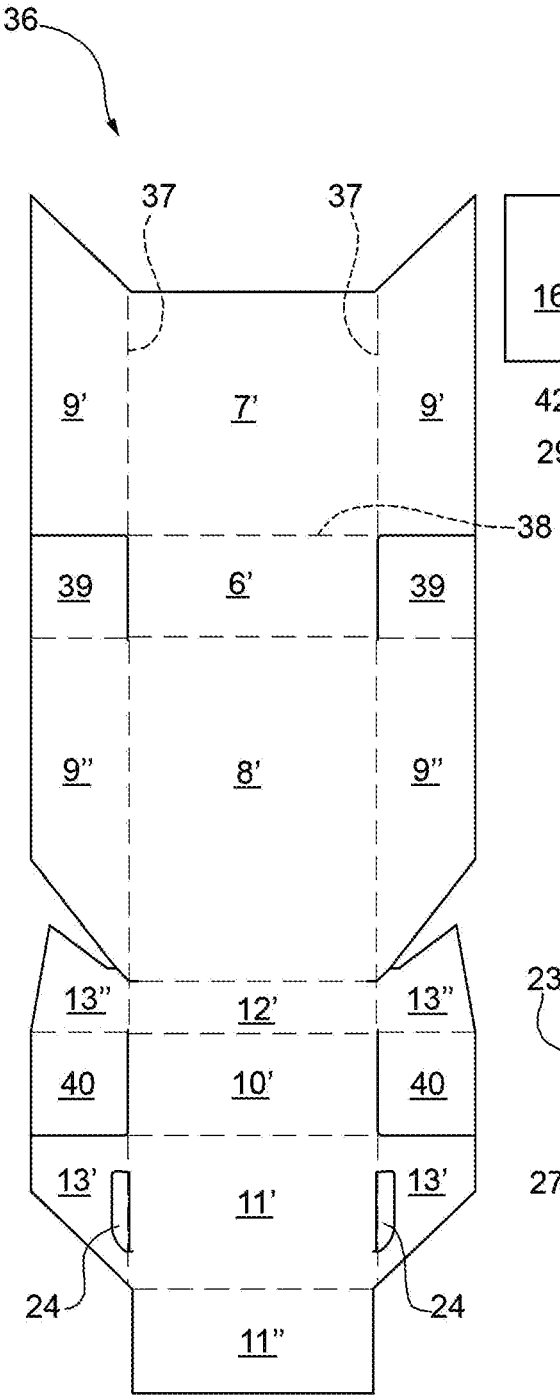
FIG. 15 is a plan view of an alternative blank used to make the outer container of the pack according to a fourth embodiment.

According to the illustration in FIGS. 9 and 15, the outer container 2 and the lid 4 are made by folding a rigid blank 36 of the conventional type, provided with a plurality of preweakened folding lines 37 and 38. The blank 36 comprises two (preweakened) longitudinal folding lines 37 and a plurality of (preweakened) transversal folding lines 38, which define, between the two preweakened longitudinal folding lines 37, a panel 7', which constitutes the front wall 7 of the outer container 2, a panel 6', which constitutes the lower wall 6 of the outer container 2, a panel 8', which constitutes the rear wall 8 of the outer container 2, a panel 12', which constitutes the rear wall 12 of the lid 4, a panel 10', which constitutes the upper wall 10 of the lid 4, a panel 11', which constitutes the front wall 11 of the lid 4, and a reinforcement flap 11". The reinforcement flap 11" is connected to the front wall 11 of the lid 4 along a preweakened transversal folding line 38, it is folded by 180° (in the pack 1 of cigarettes) relative to the front wall 11 of the lid 4 (i.e. relative to the panel 11'), and rested and glued against an inner surface of the front wall 11 of the lid 4 (i.e. against the panel 11'). The blank 36 comprises a pair of wings 9', which are arranged on opposite sides of the panel 7', they are connected to the panel 7' along the two preweakened longitudinal folding lines 37, and constitute part of the side walls 9 of the outer container 2.

The blank 36 comprises a pair of wings 9", which are arranged on opposite sides of the panel 8', they are connected to the panel 8' along the two preweakened longitudinal folding lines 37, they constitute part of the side walls 9 of the outer container 2, and are overlapped and glued to the corresponding wings 9', constituting the side walls 9 of the outer container 2.

The blank 36 comprises a pair of wings 13', which are arranged on opposite sides of the panel 11', they are connected to the panel 11' along the two preweakened longitudinal folding lines 37, and constitute part of the side walls 13 of the lid 4.

The blank 36 comprises a pair of wings 13", which are arranged on opposite sides of the panel 12', they are connected to the panel 12' along the two preweakened longitudinal folding lines 37, they constitute part of the side walls 13 of the lid 4 and are overlapped and glued to the corresponding wings 13', constituting the side walls 13 of the lid 4.

The blank 36 comprises two tabs 39, which are connected to the wings 9" along a preweakened transversal folding line 38, they are folded by 90° and rested on an inner surface of the panel 6'.

The blank 36 comprises two tabs 40, which are connected to the wings 13" along a preweakened transversal folding line 38, they are folded by 90° and rested on an inner surface of the panel 10'.

The blank 36 shown in FIGS. 9 and 15 has the respective through openings 24 at the longitudinal edges delimited by the panel 11' and the respective panels 13'.

Figure 12:
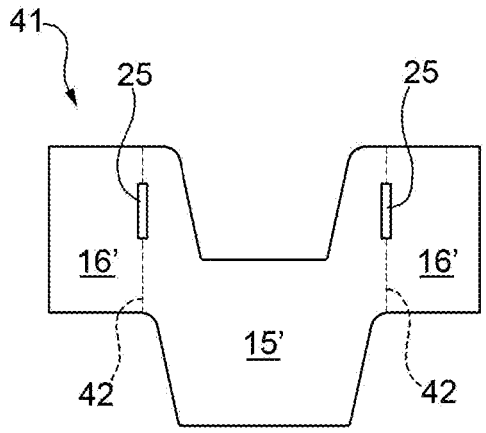
FIG. 12 is a plan view of a blank used to make the collar of the pack illustrated in FIG. 5.
Figure 16:
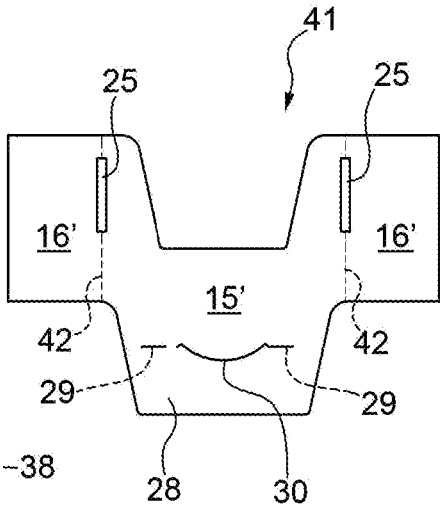
FIG. 16 is a plan view of a blank used to make the collar of the pack according to the fourth embodiment.
Figure 17:
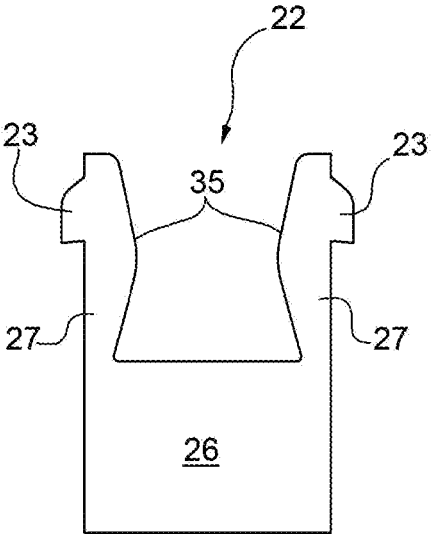
FIG. 17 is a plan view of a blank used to make the support element of the pack according to the fourth embodiment.

According to the illustration in FIGS. 10, 12 and 16, the collar 14 is made by folding a rigid blank 41 of the conventional type, provided with two preweakened longitudinal folding lines 42. The blank 41 comprises a panel 15', which constitutes the front wall 15 of the collar 14 and the two panels 16', which constitute the side walls 16 of the collar 14 respectively, which are adjacent to the panel 15'. The panel 15' and the adjacent panels 16' are separated from each other by the preweakened longitudinal folding lines 42.

Similarly, according to the illustration in FIGS. 14*a* and 14*b*, the collar 14 is made by folding the rigid blank 34, provided with two preweakened longitudinal folding lines 42. The blank 34 comprises a panel 15', which constitutes the front wall 15 of the collar 14 and two panels 16', which constitute the side walls 16 of the collar 14 respectively and which are adjacent to the panel 15'. The panel 15' and the adjacent panels 16 are separated from each other by the preweakened longitudinal folding lines 42. While the support element 22 is obtained by folding the rigid blank 34 by 180° along the preweakened transversal folding line 33 and arranging the support element 22 in contact with the collar 14.

The collar 14 in FIG. 14*a* differs from the embodiment shown in FIG. 14*b* in the positioning of the preweakened transversal folding line 33. In FIG. 14*a* the preweakened transversal folding line 33 is arranged at the appendages 27. Whereas, in FIG. 14*b* the preweakened transversal folding line 33 is arranged at the front wall 15 of the collar 14.

The collar 14 in FIGS. 10 and 16 differs from the embodiment shown in FIG. 12 in that the collar 14 comprises the portion 28 delimited, at least partially, by the preweakened folding line 29.

According to the alternative embodiments shown in FIGS. 18*a*, 18*b*, 19*a* and 19*b* the support element 22 and the collar 14 are obtained from a single element (i.e. the flat blank 34). In particular, the blank 34 shown in FIGS. 18*a*, 18*b*, 19*a* and 19*b* comprises the central panel 43, which substantially comprises (in particular constitutes) the two appendages 27 and the front wall 15 of the collar 14 and the two panels 16', which constitute the side wall 16 of the collar 14 respectively, placed side-by-side with the panel 43 on opposite sides and they are arranged adjacent to the central panel 43. The central panel 43 and panels 16' are separated from each other by the preweakened longitudinal folding lines 42 and by the separation lines 44. In particular, the preweakened longitudinal folding line 42 and the separation line 44 arranged at the sides of the central panel 43 respectively are aligned, at least partially, with each other.

As shown in FIGS. 18*a*, 18*b*, 19*a* and 19*b* the preweakened longitudinal folding line 42 is arranged at the bottom relative to the separation line 44.

Figure 19A:
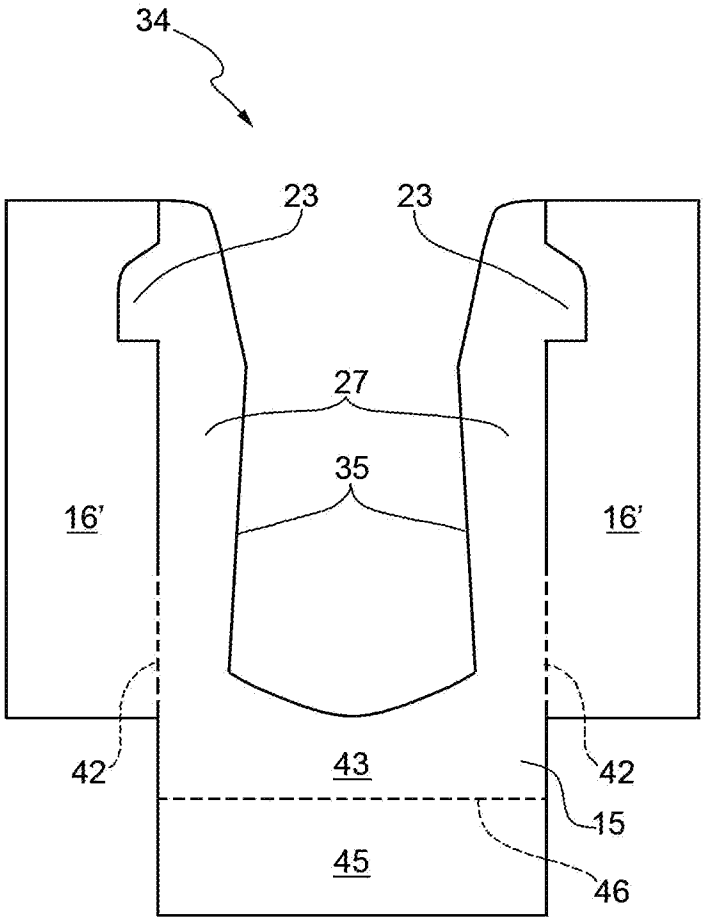
FIGS. 19*a* and 19*b* are plan views of a blank used to make the support element integrated with the collar according to an alternative embodiment.
Figure 19B:
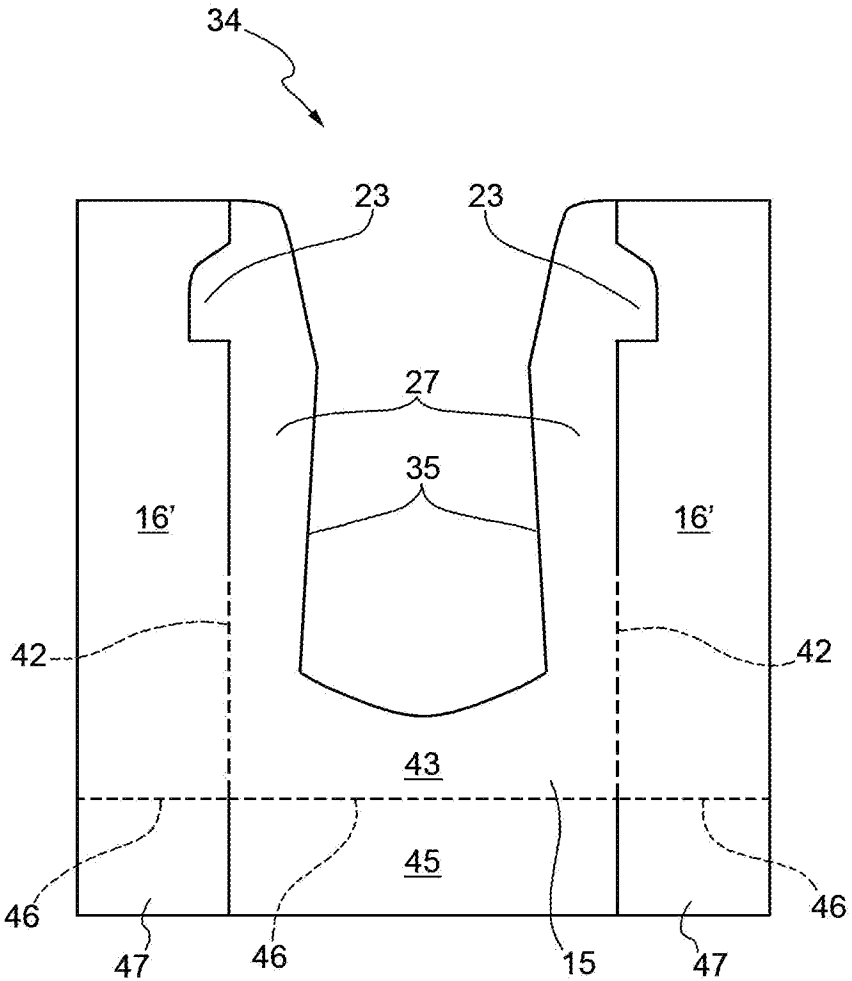

The blank 34 shown in FIGS. 19*a* and 19*b* comprises a panel 45, which is arranged at the bottom of the central panel 43. The panel 45 and the central panel 43 are separated from each other by a preweakened transversal folding line 46. In particular, the panel 45 is folded by 90° relative to the central panel 43, so it is arranged parallel to the lower wall 6 of the outer container 2.

Figure 18A:
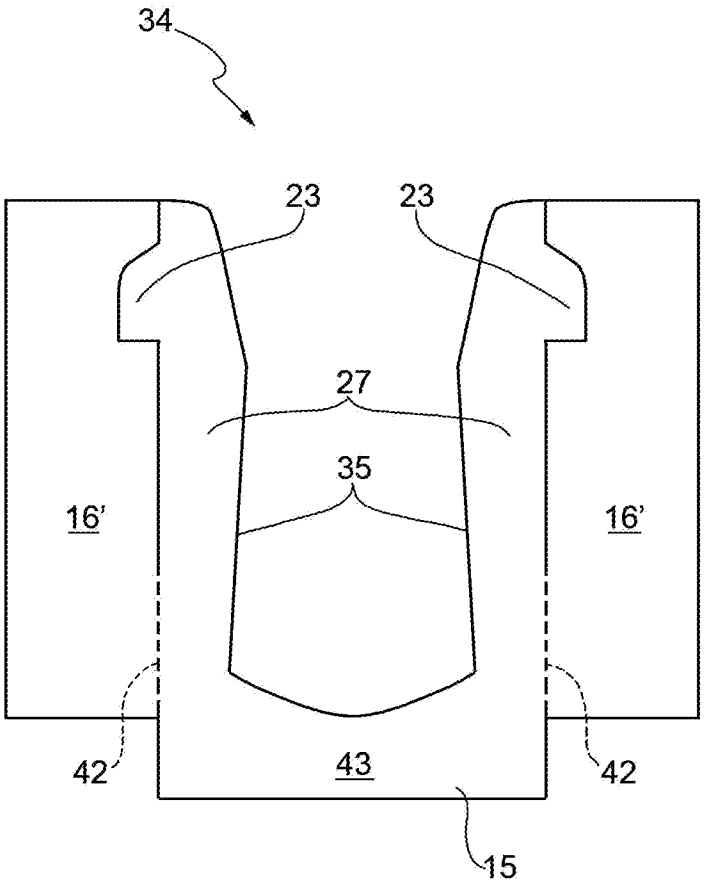
FIGS. 18*a* and 18*b* are plan views of a blank used to make the support element integrated with the collar according to an alternative embodiment.
Figure 18B:
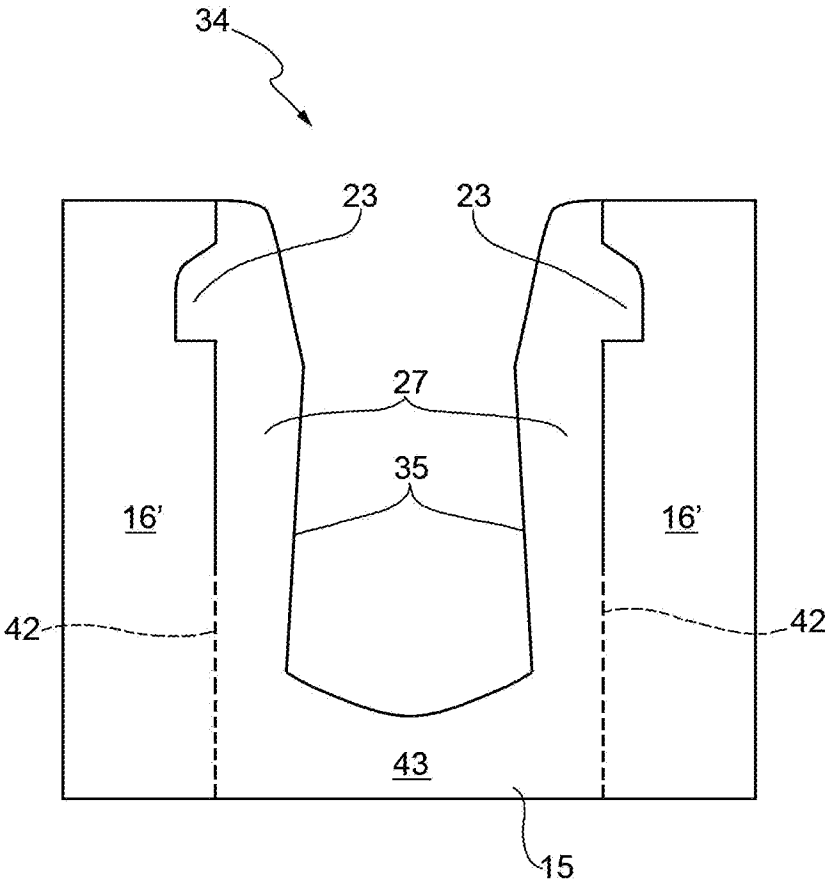

In the embodiment shown in FIGS. 18*a* and 18*b*, the lower portion of the central panel 43, or at least a portion of the panels 16', is connected, in particular glued to the outer container 2 so as to avoid a potential unthreading thereof.

According to a possible embodiment, the panel 45 is arranged in contact with the lower wall 6 without being glued thereto, as it is the wrap 18 itself, which keeps it in contact with the lower wall 6, preventing a potential unthreading thereof from the outer container 2. Alternatively, the panel 45 is arranged in contact with the lower wall 6 and it is glued thereto.

The blank 34 shown in FIGS. 18*a* and 19*a* differs from the blank 34 shown in FIGS. 18*b* and 19*b* in that the panels 16' have a longitudinal extension, i.e. parallel to the longitudinal extension of the pack 1 of cigarettes, which is lower relative to the longitudinal extension of the central panel 43.

Whereas, in the blank 34 shown in FIGS. 18*b* and 19*b*, the panels 16' have a longitudinal extension, i.e. parallel to the longitudinal extension of the pack 1 of cigarettes, which is substantially equal to the longitudinal extension of the central panel 43. The blank 34 shown in FIG. 19*b*, comprises two tabs 47, which are arranged on opposite sides of the panel 45, they are connected to the panels 16' along the preweakened transversal folding line 46, they are folded by 90° relative to the panels 16' and rested on an inner surface of the panel 45.

In the embodiments illustrated in the attached Figures, the longitudinal and transversal edges are straight; alternatively, the longitudinal and/or transversal edges could be rounded or bevelled.

The embodiments described herein can be combined without thereby departing from the protective scope of the present invention.

The pack 1 of cigarettes described above has numerous advantages.

Firstly, the pack 1 of cigarettes described above can be classified as "childproof", i.e. capable of preventing a child from opening it. In fact, to open the pack 1 of cigarettes described above, it is not enough to rotate the lid 4, but it is necessary to act on, i.e. to press the coupling wings 23 so that they disengage the respective through opening 24 of the lid 4 (shown in FIGS. 3-6), thus deactivating the locking system 21 (i.e. going from what is shown in FIGS. 1 and 2 to what is shown in FIGS. 3-6). In other words, in order to open the pack 1 of cigarettes described above, it is necessary to perform a particular sequence of movements, which are not intuitive for a child. Furthermore, projecting laterally outwards on opposite walls of the pack 1, the coupling wings 23 are spaced apart so that a child would not be able to squeeze, i.e. press both of the coupling wings 23 at the same time to deactivate the locking system 21, bringing the lid 4 into the open position.

Furthermore, in the pack 1, the subject of the present invention, by pressing the coupling wings 23 there is an elastic deformation of only the support element 22; whereas, the collar 14 remains substantially non-deformed (i.e., it is deformed by a much smaller amount relative to the support element 22, which is such as to be negligible relative to the deformation of the support element 22). In fact, being connected to the outer container 2, the collar 14 is more rigid than the support element 22, which is free, instead, to be deformed and it is made, i.e. shaped, so that it is not rigid, in particular, horse-shoe shaped.

After the initial opening of the pack 1 of cigarettes, when the lid 4 is closed completely the locking system 21 is automatically and autonomously reactivated (as shown in FIGS. 1 and 2).

Furthermore, despite being classifiable as "childproof" the opening methods of the pack 1 of cigarettes described above, are nonetheless relatively simple and obvious to an adult.

Finally, the pack 1 of cigarettes described above can be made in a packaging machine, which is not so different from a standard packaging machine for rigid packs of cigarettes with a hinged lid; consequently, the preparation of a packaging machine for producing the pack 1 of cigarettes described above doesn't have particularly elevated costs.

LIST OF THE FIGURE REFERENCE NUMERALS

1 pack of cigarettes
2 outer container

3 upper end
4 lid
5 hinge
6 lower wall
7 front wall
8 rear wall
9 side wall
10 upper wall
11 front wall
12 rear wall
13 side wall
14 collar
15 front wall
16 side wall
18 inner wrap
19 group of cigarettes
20 extraction opening
21 locking system
22 support element
23 coupling wing
24 through opening
25 seat
26 main wall
27 appendages
28 portion
29 folding line
30 cutting line
31 portion
32 folding line
33 folding line
34 blank
35 inner edge
36 blank
37 folding line
38 folding line
39 tab
40 tab
41 blank
42 folding line
43 central panel
44 separation line
45 panel
46 folding line
47 tab

The invention claimed is:

1. A pack (1) for smoking articles comprising:

a group (19) of smoking articles;

an inner wrap (18), which wraps the group (19) of smoking articles;

a rigid outer container (2), which is cup-shaped, houses the inner wrap (18) and has an open upper end (3);

a lid (4), which is cup-shaped, is hinged to the outer container along a hinge (5) so as to rotate, relative to the outer container (2), between an open position and a closed position, and has: an open lower end, an upper wall (10), a front wall (11) and a rear wall (12) opposite one another, and two side walls (13) opposite one another;

a collar (14), which is folded in a "U" shape, is inserted into the outer container (2) so as to partially project out of the open upper end (3), and has: a front wall (15) and two side walls (16) opposite one another; and a locking system (21), which prevents the lid (4) from rotating from the closed position to the open position, can be deactivated through an external action of the user, to allow the lid (4) to rotate from the closed position to the open position, and can be reactivated by rotating the lid (4) from the open position to the closed position;

wherein:

the locking system (21) comprises:

a support element (22), which is arranged in the outer container (2) in contact with the collar (14) between the inner wrap (18) and the collar (14); wherein the collar (14) has two seats (25), in the form of two second through openings or two notches, into which coupling wings (23) are inserted;

the two coupling wings (23), which project outwards and are carried by the support element (22) in a movable manner, so that they can move closer to, or away from one another; and two first through openings (24), each of which is obtained through a wall (11, 13) of the lid (4), houses at least a portion of a corresponding coupling wing (23) in order to activate the locking system (21), and releases the corresponding coupling wing (23) arranged inside it when the user acts upon the coupling wing (23) from the outside in order to deactivate the locking system (21).

2. A pack (1) according to claim 1, wherein the support element (22) has a main wall (26) and a pair of appendages (27), which are coplanar to the main wall (26), originate from opposite ends of the main wall (26), are spaced apart and separate from one another and each support a respective coupling wing (23).

3. A pack (1) according to claim 2, wherein the main wall (26) of the support element (22) is parallel to a front wall (7) of the outer container (2) and to the front wall (15) of the collar (14).

4. A pack (1) according to claim 3, wherein the front wall of the collar (14) has an extraction opening (20) having a transverse extension, which is smaller than a distance between the two appendages (27) of the support element (22) so that the front wall of the collar (14) completely covers the two appendages (27) of the support element (22).

5. A pack (1) according to claim 2, wherein at least a portion (31) of the main wall (26) of the support element (22) is folded by 180° along a first transverse folding line (32) against the appendages (27) and is glued to the appendages (27).

6. A pack (1) according to claim 2, wherein:

the support element (22) and the collar (14) are obtained from one single flat element (34), the main wall (26) of the support element (22) is connected to the front wall (15) of the collar (14); and the appendages (27) are folded by 180° against the front wall (15) of the collar (14).

7. A pack (1) according to claim 6, wherein the main wall (26) of the support element (22) is connected without gaps to the front wall (15) of the collar (14) and the appendages (27) are folded by 180° along a second transverse folding line (33) against the main wall (26) of the support element (22) and against the front wall (15) of the collar (14).

8. A pack (1) according to claim 6, wherein the main wall (26) of the support element (22) and the front wall (15) of the collar (14) are connected to one another by a third transverse folding line (33), around which they are folded by 180° so as to place the main wall (26) of the support element (22) and the appendages (27) against the front wall (15) of the collar.

9. A pack (1) according to claim 1, wherein the two coupling wings (23) are aligned with one another transversely and, similarly, the two first through openings (24) are aligned with one another transversely.

10. A pack (1) according to claim 1, wherein the two coupling wings (23) are not aligned with one another transversely and similarly, the two first through openings (24) are not aligned with one another transversely.

11. A pack (1) according to claim 1, wherein:

the outer container (2), the lid (4) and the collar (14) are made of a paper material; and the support element (22) is made of a plastic material.

* * * * *